United States Patent [19]

Cilley et al.

[11] Patent Number: 4,933,101

[45] Date of Patent: Jun. 12, 1990

[54] LIQUID AUTOMATIC DISHWASHING COMPOSITIONS COMPOUNDS PROVIDING GLASSWARE PROTECTION

[75] Inventors: William A. Cilley; Rodney M. Wise, both of Cincinnati, Ohio

[73] Assignee: The Procter & Gamble Company, Cincinnati, Ohio

[21] Appl. No.: 310,816

[22] Filed: Feb. 13, 1989

[51] Int. Cl.[5] ..... C11D 7/16; C11D 7/20; C11D 7/56

[52] U.S. Cl. ..... 252/99; 252/135; 252/174.24; 252/174.25; 252/387; 252/DIG. 14; 423/333

[58] Field of Search ..... 252/95, 99, 135; 423/333

[56] References Cited

U.S. PATENT DOCUMENTS

| | | | |
|---|---|---|---|
| 2,241,984 | 5/1941 | Cooper | 252/156 |
| 2,447,297 | 8/1948 | Wegst et al. | 252/135 |
| 2,514,304 | 7/1950 | Bacon et al. | 134/29 |
| 2,575,576 | 11/1951 | Bacon et al. | 252/138 |
| 2,892,797 | 6/1959 | Alexander et al. | 252/313 |
| 3,128,250 | 4/1964 | Lintner | 252/99 |
| 3,255,117 | 6/1966 | Knapp et al. | 252/99 |
| 3,350,318 | 10/1967 | Green | 252/135 |
| 3,410,804 | 11/1968 | Walsh | 252/99 |
| 3,640,878 | 2/1972 | Chirash et al. | 252/99 |
| 3,677,820 | 7/1972 | Rutkowski | 134/25 |
| 3,696,041 | 10/1972 | Gray | 252/99 |
| 3,701,736 | 10/1972 | Austin et al. | 252/99 |
| 3,755,180 | 8/1973 | Austin | 252/99 |
| 3,826,748 | 7/1974 | Finck | 252/99 |
| 3,852,209 | 12/1974 | Hofmann | 252/95 |
| 3,910,854 | 10/1975 | Meyer | 252/523 |
| 3,966,627 | 6/1976 | Gray | 252/99 |
| 4,018,696 | 4/1977 | Hellsten et al. | 252/135 |
| 4,102,799 | 7/1978 | Finck | 252/99 |
| 4,237,024 | 12/1980 | Fedechko | 252/99 |
| 4,329,328 | 5/1982 | McAnespie et al. | 423/333 |
| 4,416,794 | 11/1983 | Barrat et al. | 252/174.15 |
| 4,443,270 | 4/1984 | Biard et al. | 134/25.2 |
| 4,561,994 | 12/1985 | Rubin et al. | 252/187.23 |

FOREIGN PATENT DOCUMENTS

| | | |
|---|---|---|
| 62875 | 4/1971 | Australia . |
| 951211 | 7/1974 | Canada . |
| 1042753 | 11/1978 | Canada . |
| 295093 | 12/1988 | European Pat. Off. . |
| 2539531 | 3/1977 | Fed. Rep. of Germany . |
| 63045115 | 2/1988 | Japan . |
| 1285845 | 8/1972 | United Kingdom . |
| 1328073 | 8/1973 | United Kingdom . |
| 1333810 | 10/1973 | United Kingdom . |
| 1517029 | 7/1978 | United Kingdom . |
| 1586067 | 3/1981 | United Kingdom . |
| 2196972 | 5/1988 | United Kingdom . |

OTHER PUBLICATIONS

B. F. Goodrich Trade Publication GC-67 entitled, "Carbopol Water Soluble Resins".

*Primary Examiner*—Prince E. Willis
*Attorney, Agent, or Firm*—Gretchen R. Hatfield; Donald E. Hasse; Thomas H. O'Flaherty

[57] ABSTRACT

Disclosed are liquid automatic dishwashing detergent compositions containing an insoluble inorganic zinc salt useful for inhibition of glassware corrosion in the dishwasher. These compositions are particularly desirable because use of them in the dishwasher does not result in precipitation of insolubles on the dishware or dishwasher parts.

29 Claims, No Drawings

LIQUID AUTOMATIC DISHWASHING COMPOSITIONS COMPOUNDS PROVIDING GLASSWARE PROTECTION

TECHNICAL FIELD AND BACKGROUND ART

This invention relates to aqueous automatic dishwashing detergent compositions which have a yield value and are shear-thinning which further comprise insoluble inorganic zinc salts, which are useful for inhibiting glassware corrosion in an automatic dishwasher. Compositions of this general type are known. Examples of such compositions are disclosed in U.S. Pat. No. 4,116,851 to Rupe et al, issued Sept. 26, 1978; U.S. Pat. No. 4,431,559 to Ulrich, issued Feb. 14, 1984; U.S. Pat. No. 4,511,487 to Pruhs et al, issued Apr. 16, 1985; U.S. Pat. No. 4,512,908 to Heile, issued Apr. 23, 1985; Canadian Patent No. 1,031,229, Bush et al; European Patent Application No. 0130678, Heile, published Jan. 9, 1985; European Patent Application No. 0176163, Robinson, published Apr. 2, 1986; UK Patent Application No. 2,116,199A, Julemont et al, published Sept. 21, 1983; UK Patent Application No. 2,140,450A, Julemont et al, published Nov. 29, 1984; UK Patent Application No. 2,163,447A, Colarusso, published Feb. 26, 1986; UK Patent Application No. 2,164,350A, Lai et al, published Mar. 19, 1986; U.K. Patent Application No. 2,176,495A, to Drapler et al, published Dec. 31, 1986; and U.K. Patent Application No. 2,185,037A, Dixit, published July 8, 1987.

Corrosion of glass in automatic dishwashers is a well known phenomenon. A paper by D. Joubert and H. Van Daele entitled "Etching of Glassware in Mechanical Dishwashing" in Soap and Chemical Specialties, March, 1971, pp. 62, 64, and 67, discusses the influence of various detergent components, particularly those of an alkaline nature. This subject is also discussed in a paper entitled 'The Present Position of Investigations Into the Behavior of Glass During Mechanical Dishwashing' presented by Th. Altenschoepfer in April, 1971, at a symposium in Charleroi, Belgium, on "The Effect of Detergents on Glassware in Domestic Dishwashers". See also, another paper delivered at the same symposium by P. Mayaux entitled "Mechanism of Glass Attack by Chemical Agents".

It has been determined that the glassware corrosion problem actually consists of two separate phenomena; one is corrosion due to the leaching out of minerals from the glass composition itself together with hydrolysis of the silicate network, and the second is deposition and redeposition of silicate material onto the glass. It is a combination of the two that can result in the cloudy appearance of glassware that has been washed repeatedly in an automatic dishwasher. This cloudiness often manifests itself in the early stages as an iridescent film that becomes progressively more opaque with repeated washings.

Use of zinc, in general, in automatic dishwashing to prevent glass corrosion is not new. See for example, U.S. Pat. No. 3,677,820, Rutkowski, issued July 18, 1972, which discloses hanging a strip of metallic zinc in the dishwasher to prevent corrosion of glassware. U.S. Pat. No. 3,255,117, Knapp et al, issued June 7, 1966, discloses the use of soluble zinc salts in automatic dishwashing detergent compositions to prevent glassware corrosion. This reference states that introducing soluble metal salts (alkali aluminate, zincate, or berylliate) in automatic dishwashing detergent compositions can result in precipitation out of insoluble material. Such material is said to be very undesirable as it can adhere to dishwasher parts and dishware during the washing cycle. This precipitation is said to be avoided by carefully adjusting the levels and proportions of the various components in product formulation.

U.S. Pat. No. 3,350,318, Green, issued Oct. 31, 1967, also describes the use of soluble zinc salts (sodium aluminate, sodium zincate) to prevent attack by automatic dishwashing detergent compositions of overglaze colors and decorations on fine china and the aluminum of pots and pans. The problem of precipitate formation is discussed and said to be avoided by spraying a solution of the soluble zinc salt onto granular polyphosphate particles.

U.S. Pat. No. 2,575,576, Bacon et al, issued Nov. 20, 1951, describes the use of a water-soluble zinc or aluminum salt to prevent the corrosion of vitreous and ceramic surfaces. It is stated that the problem of compounding alkali metal salts such as sodium carbonates, -phosphates, -silicates, or -sulfates with water-soluble zinc or aluminum compounds is that an undesirable precipitate is formed. This problem is said to be overcome by the careful choice of particular components at particular ranges and proportions.

U.S. Pat. No. 3,755,180, Austin, issued Aug. 28, 1973, describes use of a precipitated silico-aluminate compound for inhibiting overglaze attack in china. Again, the problem of precipitate formation when soluble zinc and aluminum salts are utilized for this purpose is discussed. (See also U.S. Pat. No. 3,966,627, Gray, issued June 29, 1976.)

Despite these disclosures, there is a continuing need for automatic dishwashing detergent compositions which provide protection against glassware corrosion without causing the formation of insolubles in the dishwasher.

Accordingly, it is an object of the present invention to provide improved liquid automatic dishwashing detergent compositions which provide protection against glassware corrosion without causing the formation of insolubles in the dishwasher which can adhere to dishwasher parts and dishware.

It has been surprisingly discovered that by utilizing certain insoluble inorganic zinc salts in liquid automatic dishwashing compositions, the above objectives can be attained.

SUMMARY OF THE INVENTION

The compositions of this invention are thickened liquid automatic dishwasher detergent compositions comprising:

(1) from 0% to about 5%, preferably from about 0.1% to about 2.5%, of a preferably low-foaming, detergent surfactant;

(2) from about 5% to about 40%, preferably from about 15% to about 30%, of a detergency builder, especially a builder selected from the group consisting of sodium tripolyphosphate, sodium carbonate, potassium pyrophosphate, sodium pyrophosphate, alkali metal silicate, potassium carbonate, and mixtures thereof;

(3) a hypochlorite bleach to yield available chlorine in an amount from 0%, preferably from about 0.3%, to about 2.5%, most preferably from about 0.5% to about 1.5%;

(4) from about 0.25% to about 10%, preferably from about 0.5% to about 2%, of a thickening agent; and (5) an amount of an insoluble zinc salt having an average particle size less than 250 microns that will provide the composition with from about 0.01% to about 1.0%, preferably from about 0.02% to about 0.2%, zinc;

said composition having an apparent yield value of from about 40 to about 800, preferably from about 100 to about 600 dynes/cm$^2$.

DETAILED DESCRIPTION OF THE INVENTION

Insoluble Zinc Salt

The present invention provides a means for protecting glassware from corrosion in an automatic dishwashing process without the retention of insoluble material on dishware or dishwasher parts. The present invention provides this glassware protection by utilizing an insoluble inorganic zinc salt in a liquid automatic dishwashing detergent composition. Without wishing to be bound by theory, it is believed that zinc present in the dishwashing process deposits onto the surface of the glass, thus inhibiting mineral leaching and silicate hydrolysis which would result in corrosion. It is also believed that the zinc inhibits the deposition of silicate onto glassware during the dishwashing process, resulting in glassware which remains clear in appearance for a longer period of time than glassware which has not been treated with zinc. This treatment does not completely prevent the corrosion of glassware in the automatic dishwasher. It protects glassware against corrosion and allows glassware to remain essentially uncorroded for a longer period of time (for example, the onset of discoloration of glass may be delayed for about twice as long as is seen with untreated glass). Hence, treatment with zinc slows down the corrosion process.

Because the zinc is in a form in product which is essentially insoluble, the amount of precipitate which will form in the dishwashing process is greatly reduced. The insoluble inorganic zinc salt will dissolve only to a limited extent; hence, chemical reaction of dissolved species in the dishwashing process is controlled. Thus, use of zinc in this form allows for control of the release of reactive zinc species and precipitation of insolubles of a large and uncontrolled size in the dishwasher.

Likewise, the presence of zinc in an essentially insoluble but dispersed form inhibits the growth of large precipitates from within product solution.

It has surprisingly been discovered that zinc in this insoluble form provides glassware corrosion inhibition equivalent to that provided by soluble zinc salts.

By insoluble inorganic zinc salt is meant an inorganic zinc salt which has a solubility in water of less than 1 gram of zinc salt in 100 mls of water.

Examples of zinc salts which meet this criterion, and hence are covered by the present invention, are zinc silicate, zinc carbonate, zinc oxide, zinc basic carbonate (approximately $Zn_2(OH)_2CO_3$), zinc hydroxide, zinc oxalate, zinc monophosphate ($Zn_3(PO_4)_2$), and zinc pyrophosphate ($Zn_2(P_2O_7)$).

The level of insoluble zinc salt necessary to achieve the glassware protection benefit of the present invention is an amount that provides the composition with a level of zinc between about 0.01% and about 1.0%, preferably between about 0.02% to about 0.2%. An amount less than about 0.01% zinc is insufficient to provide the desired protection against glassware corrosion. An amount of insoluble inorganic zinc salt that would provide more than 1.0% zinc would be difficult to keep dispersed in the liquid medium and would not provide an appreciable increase in glassware protection benefit. The exact level to be used will depend somewhat on the particular insoluble inorganic zinc salt used in the composition. The more insoluble the salt, the greater amount necessary to achieve the same level of benefit. This is because less zinc will solubilize in the dishwasher and become available for treatment of the glassware.

The remainder of the dishwashing composition formulation will also affect efficacy of the insoluble inorganic zinc salt in delivering glassware protection. For example, for compositions with higher levels of builder components, a higher level of insoluble inorganic zinc salt may be needed to achieve the same glassware protection benefit that would be seen with formulas having lower levels of builder material.

Since most of the insoluble zinc material will remain in essentially the same form throughout the dishwashing process, it is important that the particle size of the insoluble inorganic zinc salt be small enough so that the material will pass through the dishwashing process without adhering to dishware or dishwasher parts. If the average particle size of the insoluble zinc salt is kept below the above mentioned 250 microns, insolubles in the dishwasher are not a problem. Preferably, the insoluble inorganic zinc salt material has an average particle size even smaller than this to insure against insolubles on dishware in the dishwasher, e.g., a size smaller than 100 microns. This is especially true when high levels of insoluble inorganic zinc salts are utilized. Otherwise, the salts may not stay dispersed in the liquid medium of the composition over extended periods of storage. Furthermore, the smaller the particle size, the more efficient the insoluble inorganic zinc salt in protecting glassware. If a very low level of insoluble inorganic zinc salt is utilized, it is most desirable to use material having a very small particle size, e.g., smaller than about 100 microns. For the very insoluble inorganic zinc salts, a smaller particle size may be necessary to get the desired efficacy for glassware protection. For example, with zinc oxide, a desired particle size might be less than about 100 microns.

Detergent Surfactants

The compositions of this invention can contain from 0% to about 5.0%, preferably from about 0.1% to about 2.5%, of a detergent surfactant. Desirable detergent surfactants, in general, include nonionic detergent surfactants, anionic detergent surfactants, amphoteric and zwitterionic detergent surfactants, and mixtures thereof.

Examples of nonionic surfactants include:

(1) The condensation product of 1 mole of a saturated or unsaturated, straight or branched chain, alcohol or fatty acid containing from about 10 to about 20 carbon atoms with from about 4 to about 50 moles of ethylene oxide. Specific examples of such compounds include a condensation product of 1 mole of coconut fatty acid or tallow fatty acid with 10 moles of ethylene oxide; the condensation of 1 mole of oleic acid with 9 moles of ethylene oxide; the condensation product of 1 mole of stearic acid with 25 moles of ethylene oxide; the condensation product of 1 mole of tallow fatty alcohols with about 9 moles of ethylene oxide; the condensation product of 1 mole of oleyl alcohol with 10 moles of ethylene oxide; the condensation product of 1 mole of $C_{19}$ alcohol and 8 moles of ethylene oxide; and the condensation product of one mole of $C_{18}$ alcohol and 9 moles of ethylene oxide.

The condensation product of a fatty alcohol containing from 17 to 19 carbon atoms, with from about 6 to about 15 moles, preferably 7 to 12 moles, most preferably 9 moles, of ethylene oxide provides superior spotting and filming performance. More particularly, it is desirable that the fatty alcohol contain 18 carbon atoms and be condensed with from about 7.5 to about 12, preferably about 9, moles of ethylene oxide. These various specific $C_{17}$–$C_{19}$ ethoxylates give extremely good performance even at lower levels (e.g., 2.5%–3%) and at the higher levels (less than 5%) are sufficiently low sudsing, especially when capped with a low molecular weight ($C_{1-5}$) acid or alcohol moiety, so as to minimize or eliminate the need for a suds-suppressing agent. Suds-suppressing agents in general tend to act as a load on the composition and to hurt long term spotting and filming characteristics.

(2) Polyethylene glycols or polypropylene glycols having molecular weight of from about 1,400 to about 30,000, e.g., 20,000; 9,500; 7,500; 6,000; 4,500; 3,400; and 1,450. All of these materials are wax-like solids which melt between 110° F. and 200° F.

(3) The condensation products of 1 mole of alkyl phenol wherein the alkyl chain contains from about 8 to about 18 carbon atoms and from about 4 to about 50 moles of ethylene oxide. Specific examples of these nonionics are the condensation products of 1 mole of decylphenol with 40 moles of ethylene oxide; the condensation product of 1 mole of dodecyl phenol with 35 moles of ethylene oxide; the condensation product of 1 mole of tetradecylphenol with 25 moles of ethylene oxide; the condensation product of 1 mole of hectadecylphenol with 30 moles of ethylene oxide, etc.

(4) Polyoxypropylene, polyoxyethylene condensates having the formula $HO(C_2H_4O)_x(C_3H_6O)_y(C_2H_4O)_xH$ or $HO(C_3H_6O)_y(C_2H_4O)_x(C_3H_6O)_yH$ where total y equals at least 15 and total $(C_2H_4O)$ equals 20% to 90% of the total weight of the compound and the molecular weight is from about 2,000 to about 10,000, preferably from about 3,000 to about 6,000. These materials are, for example, the Pluronics which are well known in the art.

(5) The compounds of (1) which are capped with propylene oxide, butylene oxide and/or short chain alcohols and/or short chain fatty acids, e.g., those containing from 1 to about 5 carbon atoms, and mixtures thereof.

Useful surfactants in detergent compositions are those having the formula $RO—(C_2H_4O)_xR^1$ wherein R is an alkyl or alkylene group containing from 17 to 19 carbon atoms, x is a number from about 6 to about 15, preferably from about 7 to about 12, and $R^1$ is selected from the group consisting of: preferably, hydrogen, $C_{1-5}$ alkyl groups, $C_{2-5}$ acyl groups and groups having the formula $—(C_yH_{2y}O)_nH$ wherein y is 3 or 4 and n is a number from one to about 4.

Particularly suitable surfactants are the low-sudsing compounds of (4), the other compounds of (5), and the $C_{17-19}$ materials of (1) which have a narrow ethoxy distribution.

In addition to the above mentioned surfactants, other suitable surfactants for detergent compositions can be found in the disclosures of U.S. Pat. Nos. 3,544,473, 3,630,923, 3,888,781 and 4,001,132, all of which are incorporated herein by reference.

Some of the aforementioned surfactants are bleach-stable but some are not. When the composition contains a hypochlorite bleach it is preferable that the detergent surfactant is bleach-stable. Such surfactants desirably do not contain functions such as unsaturation and some aramatic, amide, aldehydic, methyl keto or hydroxyl groups which are susceptible to oxidation by the hypochlorite.

Bleach-stable anionic surfactants which are especially resistant to hypochlorite oxidation fall into two main groups. One such class of bleach-stable anionic surfactants are the water-soluble alkyl sulfates and/or sulfonates, containing from about 8 to 18 carbon atoms in the alkyl group. Alkyl sulfates are the water-soluble salts of sulfated fatty alcohols. They are produced from natural or synthetic fatty alcohols containing from about 8 to 18 carbon atoms Natural fatty alcohols include those produced by reducing the glycerides of naturally occurring fats and oils. Fatty alcohols can be produced synthetically, for example, by the Oxo process Examples of suitable alcohols which can be employed in alkyl sulfate manufacture include decyl, lauryl, myristyl, palmityl and stearyl alcohols and the mixtures of fatty alcohols derived by reducing the glycerides of tallow and coconut oil.

Specific examples of alkyl sulfate salts which can be employed in the instant detergent compositions include sodium lauryl alkyl sulfate, sodium stearyl alkyl sulfate, sodium palmityl alkyl sulfate, sodium decyl sulfate, sodium myristyl alkyl sulfate, potassium lauryl alkyl sulfate, potassium stearyl alkyl sulfate, potassium decyl sulfate, potassium palmityl alkyl sulfate, potassium myristyl alkyl sulfate, sodium dodecyl sulfate, potassium dodecyl sulfate, potassium tallow alkyl sulfate, sodium tallow alkyl sulfate, sodium coconut alkyl sulfate, magnesium coconut alkyl sulfate, calcium coconut alkyl sulfate, potassium coconut alkyl sulfate and mixtures of these surfactants. Highly preferred alkyl sulfates are sodium coconut alkyl sulfate, potassium coconut alkyl sulfate, potassium lauryl alkyl sulfate and sodium lauryl alkyl sulfate.

A second class of bleach-stable surfactant materials operable in the instant invention are the water-soluble betaine surfactants. These materials have the general formula:

$$R_1—\overset{\overset{R_2}{|}}{\underset{\underset{R_3}{|}}{N^{(+)}}}—R_4—COO^{(-)}$$

wherein $R_1$ is an alkyl group containing from about 8 to 18 carbon atoms; $R_2$ and $R_3$ are each lower alkyl groups containing from about 1 to 4 carbon atoms, and $R_4$ is an alkylene group selected from the group consisting of methylene, propylene, butylene and pentylene. (Propionate betaines decompose in aqueous solution and hence are not included in the instant compositions).

Examples of suitable betaine compounds of this type include dodecyldimethylammonium acetate, tetradecyldimethylammonium acetate, hexadecyldimethylammonium acetate, alkyldimethylammonium acetate wherein the alkyl group averages about 14.8 carbon atoms in length, dodecyldimethylammonium butanoate, tetradecyldimethylammonium butanoate, hexadecyldimethylammonium butanoate, dodecyldimethylammonium hexanoate, hexadecyldimethylammonium hexanoate, tetradecyldiethylammonium pentanotate and tetradecyldipropyl ammonium pentanoate. Especially preferred betaine surfactants include dodecyldimethylammonium acetate, dodecyldimethylammonium hexanoate, hexadecyldimethylammonium acetate, and hexadecyldimethylammonium hexanoate.

Nonionic surfactants useful herein include ethoxylated and/or propoxylated nonionic surfactants such as those available from BASF Corp. of New Jersey. Examples of such compounds are polyethylene oxide, polypropylene oxide block copolymers sold under the trade names Pluronic® Tetronic® available from BASF Corp.

Preferred members of this class are capped oxyalkylene oxide block copolymer surfactants of the following structure:

$$\begin{array}{l} \diagup (AO_1)_x-(AO_2)_y-(AO_3)_z-R \\ I \\ \diagdown ((AO_1)_{x'}-(AO_2)_{y'}-(AO_3)_{z'}-R')_w \end{array}$$

where I is the residue of a monohydroxyl, dihydroxyl, or a polyhydroxyl compound; $AO_1$, $AO_2$, and $AO_3$ are oxyalkyl groups and one of $AO_1$ and $AO_2$ is propylene oxide with the corresponding x or y being greater than zero, and the other of $AO_1$ and $AO_2$ is ethylene oxide with the corresponding x or y being greater than zero, and the molar ratio of propylene oxide to ethylene oxide is from about 2:1 to about 8:1; R and R' are hydrogen, alkyl, aryl, alkyl aryl, aryl alkyl, carbamate, or butylene oxide; w is equal to zero or one; and z, x', y', and z' are greater than or equal to zero.

Of these compounds, the following structures are preferred:

$$I-(PO)_x-(EO)_y-(BO)_z-H \quad (1)$$

$$I-(PO)_x-(EO)_y-CH_3 \quad (2)$$

$$\begin{array}{l} \diagup (PO)_x-(EO)_y-(BO)_z-H \\ I' \\ \diagdown (PO)_{x'}-(EO)_{y'}-(BO)_{z'}-H \end{array} \quad (3)$$

$$\begin{array}{l} \diagup (PO)_x-(EO)_y-CH_3 \\ I' \\ \diagdown (PO)_{x'}-(EO)_{y'}-CH_3 \end{array} \quad (4)$$

These compounds preferably have molecular weights ranging from about 1000 to about 4000. In these structures I is the residue of a monohydroxyl compound, preferably the residue of methanol, ethanol, or butanol, and I' is the residue of a dihydroxyl compound, preferably ethylene glycol, propylene glycol, or butylene glycol. Also, EO is an ethylene oxide group; PO is a propylene oxide group; BO is a butylene oxide group; x and x' are the number of propylene oxide groups; y and y' are the number of ethylene oxide groups; and z and z' are the number of butylene oxide groups. Also z and z' are each greater than zero and preferably are each equal to from about 1 to about 5; x, y, x', and y' are each greater than zero, and the ratio of x to y and x' to y' is from about 3:1 to about 6:1.

The above structures in which the (EO)y and (PO)x sequencing order are reversed are also useful in the present invention. In these reverse structures, y and y' are the number of propylene oxide groups; x and x' are the number of ethylene oxide groups; and the ratio of y to x and y' to x' is from about 3:1 to about 6:1.

Most preferably the nonionic surfactants comprise the following:

$$CH_3-O-(PO)_x-(EO)_y-C-\underset{\underset{C}{|}}{\overset{\overset{C}{|}}{C}}-O-C-\underset{\underset{C}{|}}{\overset{\overset{C}{|}}{C}}-OH; \quad (1)$$

or $$\begin{array}{l} \diagup O-(PO)_x-(EO)_y-CH_3 \\ C \\ | \\ C \\ \diagdown O-(PO)_{x'}-(EO)_{y'}-CH_3 \end{array} \quad (2)$$

both molecules having a molecular weight of about 1900, wherein PO is propylene oxide, EO is ethylene oxide, and the molar ratio of PO to EO is from about 4:1 to about 5:1. These surfactants are not only bleach-stable, but they provide low sudsing and superior performance in reducing spotting and filming as well. The preferred of these particular nonionic surfactants is that of formula (1), as this compound is easier to prepare. However, from a bleach stability and performance standpoint, both compounds are equivalent.

Other bleach-stable surfactants include amine oxides, phosphine oxides, and sulfoxides. However, such surfactants are usually high sudsing. A disclosure of bleach-stable surfactants can be found in published British Patent Application No. 2,116,199A; U.S. Pat. No. 4,005,027, Hartman; U.S. Pat. No. 4,116,851, Rupe et al; U.S. Pat. No. 3,985,668, Hartman; U.S. Pat. No. 4,271,030, Brierley et al; and U.S. Pat. No. 4,116,849, Leikhim, all of which are incorporated herein by reference.

Other desirable bleach-stable surfactants are the alkyl phosphonates, taught in U.S. Pat. No. 4,105,573, to Jacobsen, issued Aug. 8, 1978, incorporated herein by reference.

Still other preferred bleach-stable anionic surfactants include the linear or branched alkali metal mono- and/or di-($C_{8-14}$) alkyl diphenyl oxide mono- and/or disulphonates, commercially available under the trade names Dowfax 3B-2 (sodium n-decyl diphenyloxide disulfonate) and Dowfax 2A-1. These and similar surfactants are disclosed in published U.K. Pat. No. Application Nos. 2,163,447A; 2,163,448A; and 2,164,350A, said applications being incorporated herein by reference.

Bleaching Agent

The instant compositions optionally and desirably include a bleaching agent which yields a hypochlorite species in aqueous solution. The hypochlorite ion is chemically represented by the formula $OCl^-$. The hypochlorite ion is a strong oxidizing agent, and for this reason materials which yield this species are considered to be powerful bleaching agents.

The strength of an aqueous solution containing hypochlorite ion is measured in terms of available chlorine. This is the oxidizing power of the solution measured by the ability of the solution to liberate iodine from an acidified iodide solution. One hypochlorite ion has the oxidizing power of 2 atoms of chlorine, i.e., one molecule of chlorine gas.

At lower pH levels, aqueous solutions formed by dissolving hypochlorite-yielding compounds contain active chlorine, partially in the form of hypochlorous acid moieties and partially in the form of hypochlorite ions. At pH levels above about 10, i.e., at the preferred pH levels of the instant compositions, essentially all of the active chlorine is in the form of hypochlorite ion.

Those bleaching agents which yield a hypochlorite species in aqueous solution include alkali metal and alkaline earth metal hypochlorites, hypochlorite addition products, chloramines, chlorimines, chloramides, and chlorimides. Specific examples of compounds of this type include sodium hypochlorite, potassium hypochlorite, monobasic calcium hypochlorite, dibasic magnesium hypochlorite, chlorinated trisodium phosphate dodecahydrate, potassium dichloroisocyanurate, sodium dichloroisocyanurate, sodium dichloroisocyanurate dihydrate, trichlorocyanuric acid, 1,3-dichloro-5,5-dimethylhydantoin, N-chlorosulfamide, Chloramine T, Dichloramine T, Chloramine B and Dichloramine B. A preferred bleaching agent for use in the compositions of the instant invention is sodium hypochlorite.

Most of the above-described hypochlorite-yielding bleaching agents are available in solid or concentrated form and are dissolved in water during preparation of the compositions of the instant invention. Some of the above materials are available as aqueous solutions.

If present, the above-described bleaching agents are dissolved in the aqueous liquid component of the present composition. Bleaching agents can provide from about 0.3% to about 2.5% available chlorine by weight, preferably from about 0.5% to about 1.5% available chlorine by weight, of the total composition.

Alternatively, bleaching agents other than hypochlorite, such as oxygen bleaches, can be used with the instant compositons.

Buffering Agent

In the instant compositions, it is generally desirable to also include one or more buffering agents capable of maintaining the pH of the compositions within the alkaline range. It is in this pH range that optimum performance of the bleach and surfactant are realized, and it is also within this pH range wherein optimum composition chemical stability is achieved.

When the essential thickening agent is a clay material, and when a hypochlorite bleach is optionally included in the instant compositions, maintenance of the composition pH within the 10.5 to 12.5 range minimizes undesirable chemical decomposition of the active chlorine, hypochlorite-yielding bleaching agents, said decomposition generally being encountered when such bleaching agents are admixed with clay in unbuffered aqueous solution. Maintenance of this particular pH range also minimizes the chemical interaction between the strong hypochlorite bleach and the surfactant compounds present in the instant compositions. Finally, as noted, high pH values such as those maintained by an optional buffering agent serve to enhance the soil and stain removal properties during utilization of the present compositions.

Any compatible material or mixture of materials which has the effect of maintaining the composition pH within the alkaline pH range, and preferably within the 10.5 to 12.5 range, can be utilized as the buffering agent in the instant invention. Such materials can include, for example, various water-soluble, inorganic salts such as the carbonates, bicarbonates, sesquicarbonates, silicates, pyrophosphates, phosphates, tetraborates, and mixtures thereof. Examples of materials which can be used either alone or in combination as the buffering agent herein include sodium carbonate, sodium bicarbonate, potassium carbonate, sodium sesquicarbonate, sodium silicate, potassium silicate, sodium pyrophosphate, tetrapotassium pyrophosphate, tripotassium phosphate, trisodium phosphate, anhydrous sodium tetraborate, sodium tetraborate pentahydrate, potassium hydroxide, sodium hydroxide, and sodium tetraborate decahydrate. Combination of these buffering agents, which include both the sodium and potassium salts, may be used. This may include mixtures of tetrapotassium pyrophosphate and trisodium phosphate in a pyrophosphate/phosphate weight ratio of about 3:1, mixtures of tetrapotassium pyrophosphate and tripotassium phosphate in a pyrophosphate/phosphate weight ratio of about 3:1, and mixtures of anhydrous sodium carbonate and sodium silicate in a carbonate/silicate weight ratio of about 1:3 to about 3:1, preferably from about 1:2 to about 2:1.

If present, the above-described buffering agent materials are dissolved or suspended in the aqueous liquid component. Buffering agents can generally comprise from about 2% to 20% by weight, preferably from about 5% to 15% by weight, of the total composition.

Detergency Builder

Detergency builders are desirable materials which reduce the free calcium and/or magnesium ion concentration in a surfactant-containing aqueous solution. They are used herein at a level of from about 5% to about 40%, preferably from about 15% to about 30%. The preferred detergency builder for use herein is sodium tripolyphosphate in an amount from about 10% to about 40%, preferably from about 15% to about 30%. Generally a certain percentage of the sodium tripolyphosphate is in an undissolved particulate form suspended in the rest of the detergent composition. The phosphate ester, if present in the composition, works to keep such solid particles suspended in the aqueous solution.

The detergency builder material can be any of the detergent builder materials known in the art which include trisodium phosphate, tetrasodiumpyrophosphate, sodium tripolyphosphate, sodium potassium pyrophosphate, potassium tripolyhexametaphosphate, phosphate, potassium hexametaphosphate, sodium silicates having $SiO_2$:$Na_2O$ weight ratios of from about 1:1 to about 3.6:1, sodium carbonate, sodium hydroxide, sodium citrate, borax, sodium ethylenediaminetetraacetate, sodium nitrilotriacetate, sodium carboxymethyloxysuccinate, sodium carboxymethyloxymalonate polyphosphonates, salts of low molecular weight carboxylic acids, polycarboxylates, polymeric carboxylates such as polyacrylates, and mixtures thereof.

Some of the above-described buffering agent materials additionally serve as builders. It is preferred that the buffering agent contain at least one compound capable of additionally acting as a builder.

The Thickening Agent

Any material or materials which can be admixed with the aqueous liquid to provide shear-thinning compositions having sufficient yield values can be used in the compositions of this invention. The most common thickening agents are clays, but materials such as colloidal silica, particulate polymers, such as polystyrene and oxidized polystyrene, combinations of certain surfactants, and water-soluble polymers such as polyacrylate are also known to provide yield values.

A synthetic clay that may be used in the compositions of the present invention is the one disclosed in U.S. Pat. No. 3,843,548, incorporated herein by reference. Naturally occurring clays include smectites and attapulgites. These colloidal materials can be described as expandable layered clays, i.e., aluminosilicates and magnesium silicates. The term "expandable" as used to describe the instant clays relates to the ability of the layered clay structure to be swollen, or expanded, on contact with water. The expandable clays used herein are those materials classified geologically as smectites (or montmorillonoids) and attapulgites (or palygorskites).

Smectites are three-layered clays. There are two distinct classes of smectite-clays. In the first, aluminum oxide is present in the silicate crystal lattice; in the second class of smectites, magnesium oxide is present in the silicate crystal lattice. The general formulas of these smectites are $Al_2(Si_2O_5)_2(OH)_2$ and $Mg_3(Si_2O_5)(OH)_2$, for the aluminum and magnesium oxide type clays, respectively. It is to be recognized that the range of the water of hydration in the above formulas can vary with the processing to which the clay has been subjected. This is immaterial to the use of the smectite clays in the present compositions in that the expandable characteristics of the hydrated clays are dictated by the silicate lattice structure. Furthermore, atom substitution by iron and magnesium can occur within the crystal lattice of the smectites, while metal cations such as $Na^+$ and $Ca^{++}$, as well as $H^+$, can be copresent in the water of hydration to provide electrical neutrality. Although the presence of iron in such clay material is preferably avoided to minimize adverse reactions, e.g., a chemical interaction between clay and bleach, such cation substitutions in general are immaterial to the use of the clays herein since the desirable physical properties of the clay are not substantially altered thereby.

The layered expandable aluminosilicate smectite clays useful herein are further characterized by a dioctahedral crystal lattice, whereas the expandable magnesium silicate clays have a trioctahedral crystal lattice.

The smectite clays used in the compositions herein are all commercially available. such clays include for example, montmorillonite (bentonite), volchonskoite, nontronite, beidellite, hectorite, saponite, sauconite and vermiculite. The clays herein are available under commercial names such as "Fooler Clay" (clay found in a relatively thin vein above the main bentonite or montmorillonite veins in the Black Hills) and various trade names such as Thixogel No. I and Gelwhite GP from ECC America, Inc. (both montmorillonites); Volclay BC, Volclay No. 325, and especially Volclay HPM-20 and Polar Gel-T from American Colloid Company, Skokie, Illinois; Black Hills Bentonite BH 450, from International Minerals and Chemicals; Veegum Pro and Veegum F, from R. T. Vanderbilt (both hectorites); Barasym NAS-100, Barasym NAH-100, Barasym SMM 200, and Barasym LIH-200, all synthetic hectorites and saponites marketed by Baroid Division, NL, Industries, Inc.

Smectite clays are preferred for use in the instant invention. Montmorillonite, hectorite and saponite are the preferred smectites. Gelwhite GP, Barasym NAS-100, Barasym NAH-100, Polar Gel-T, and Volclay HPM-20 are the preferred montmorillonites, hectorites and saponites.

A second type of expandable clay material useful in the instant invention is classified geologically as attapulgite (palygorskite). Attapulgites are magnesium-rich clays having principles of superposition of tetrahedral and octahedral unit cell elements different from the smectites. An idealized composition of the attapulgite unit cell is given as:

$$(OH_2)_4(OH)_2Mg_5Si_8O_{20}.4H_2O.$$

A typical attapulgite analyses yields 55.02% $SiO_2$; 10.24% $Al_2O_3$; 3.53% $Fe_2O_3$; 10.45% MgO; 0.47% $K_2O$; 9.73% $H_2O$ removed at 150° C.; 10.13% $H_2O$ removed at higher temperatures.

Like the smectites, attapulgite clays are commercially available. For example, such clays are marketed under the trade name Attagel, i.e. Attagel 40, Attagel 50 and Attagel 150 from Engelhard Minerals & Chemicals Corporation.

Particularly preferred for the colloid-forming clay component in certain embodiments of the instant composition are mixtures of smectite and attapulgite clays. in general, such mixed clay compositions exhibit increased and prolonged fluidity upon application of shear stress but are still adequately thickened solutions at times when flow is not desired. Clay mixtures in a smectite/attapulgite weight ratio of from 5:1 to 1:5 are preferred. Ratios of from 2:1 to 1:2 are more preferred. A ratio of about 1:1 is most preferred.

As noted above, the clays employed in the compositions of the present invention contain cationic counter ions such as protons, sodium ions, potassium ions, calcium ions, magnesium ions and the like. It is customary to distinguish between clays on the basis of one cation which is predominately or exclusively absorbed. For example a sodium clay is one in which the absorbed cation is predominately sodium. Such absorbed cations can become involved in exchange reactions with cations present in aqueous solutions. It is preferred that the present compositions contain up to about 12% or preferably up to about 8% potassium ions since they improve the viscosity increasing characteristics of the clay. Preferably at least 1%, more preferably at least 2% of the potassium ions are present.

Hectorites can also be used, particularly those of the types described in U.S. Pat. Nos. 4,511,487 and 4,512,908, previously incorporated herein by reference.

Specific preferred clays are disclosed in U.S. Pat. Nos. 3,993,573 and 4,005,027, incorporated herein by reference. These materials are preferred for thickening. The amount of clay will normally be from about 0.25% to about 10%, preferably from about 0.5% to about 2%.

If clay is used as a thickening agent in the compositions of the present invention preferably nonionic surfactants are not used. This is because such a composition would not be phase stable.

Other thickening agents which are useful in this invention include those disclosed in U.S. Pat. No. No. 3,393,153, incorporated herein by reference, including colloidal silica having a mean particle diameter ranging from about 0.01 micron to about 0.05 micron and particulate polymers such as polystyrene, oxidized polystyrene having an acid number of from 20 to about 40, sulfonated polystyrene having an acid number of from about 10 to about 30, polyethylene, oxidized polyethylene having an acid number of from about 10 to about 30;

sulfonated polyethylene having an acid number of from about 5 to about 25; polypropylene, oxidized polypropylene having an acid number of from about 10 to about 30 and sulfonated polypropylene having an acid number of from about 5 to about 25, all of said particulate polymers having mean particle diameters ranging from about 0.01 micron to about 30 microns. Other examples include copolymers of styrene with monomers such as maleic anhydride, nitrilonitrile, methacrylic acid and lower alkyl esters of methacrylic acid. Other materials include copolymers of styrene with methyl or ethyl acrylate, methyl or ethyl maleate, vinyl acetate, acrylic maleic or fumaric acids and mixtures thereof. The mole ratio of ester and/or acid to styrene being in the range from about 4 to about 40 styrene units per ester and/or acid unit. The latter materials having a mean particle diameter range of from about 0.05 micron to about 1 micron and molecular weights ranging from about 500,000 to about 2,000,000.

Still other thickening agents useful herein are described in U.S. Pat. No. 4,226,736 to Bush et al, issued Oct. 7, 1980 and incorporated herein by reference.

The compositions contain from about 0.25% to about 10%, preferably from about 0.5% to about 2.0%, of thickening agent.

A preferred thickening agent useful in the compositions of the present invention is a high molecular weight polycarboxylate polymer thickener. By "high molecular weight" is meant from about 500,000 to about 5,000,000, preferably from about 750,000 to about 4,000,000.

The polycarboxylate polymer may be a carboxyvinyl polymer. Such compounds are disclosed in U.S. Pat. No. 2,798,053, issued on July 2, 1957, to Brown, the specification of which is hereby incorporated by reference. Methods for making carboxyvinyl polymers are also disclosed in Brown.

A carboxyvinyl polymer is an interpolymer of a monomeric mixture comprising a monomeric olefinically unsaturated carboxylic acid, and from about 0.1% to about 10% by weight of the total monomers of a polyether of a polyhydric alcohol, which polyhydric alcohol contains at least four carbon atoms to which are attached at least three hydroxyl groups, the polyether containing more than one alkenyl group per molecule. Other monoolefinic monomeric materials may be present in the monomeric mixture if desired, even in predominant proportion. Carboxyvinyl polymers are substantially insoluble in liquid, volatile organic hydrocarbons and are dimensionally stable on exposure to air.

Preferred polyhydric alcohols used to produce carboxyvinyl polymers include polyols selected from the class consisting of oligosaccarides, reduced derivatives thereof in which the carbonyl group is converted to an alcohol group, and pentaerythritol; more preferred are oligosaccharides, most preferred is sucrose. It is preferred that the hydroxyl groups of the polyol which are modified be etherified with allyl groups, the polyol having at least two allyl ether groups per polyol molecule. When the polyol is sucrose, it is preferred that the sucrose have at least about five allyl ether groups per sucrose molecule. It is preferred that the polyether of the polyol comprise from about 0.1% to about 4% of the total monomers, more preferably from about 0.2% to about 2.5%.

Preferred monomeric olefinically unsaturated carboxylic acids for use in producing carboxyvinyl polymers used herein include monomeric, polymerizable, alpha-beta monoolefinically unsaturated lower aliphatic carboxylic acids; more preferred are monomeric monoolefinic acrylic acids of the structure

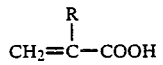

where R is a substituent selected from the group consisting of hydrogen and lower alkyl groups; most preferred is acrylic acid.

Carboxyvinyl polymers useful in formulations of the present invention have a molecular weight of at least about 750,000; preferred are highly cross-linked carboxyvinyl polymers having a molecular weight of at least about 1,250,000; also preferred are carboxyvinyl polymers having a molecular weight of at least about 3,000,000, which may be less highly cross-linked.

Various carboxyvinyl polymers are commercially available from B. F. Goodrich Company, New York, N.Y., under the trade name Carbopol. These polymers are also known as carbomers or polyacrylic acids. Carboxyvinyl polymers useful in formulations of the present invention include Carbopol 910 having a molecular weight of about 750,000, preferred Carbopol 941 having a molecular weight of about 1,250,000, and more preferred Carbopols 934 and 940 having molecular weights of about 3,000,000 and 4,000,000, respectively.

Carbopol 934 is a very slightly cross-linked carboxyvinyl polymer having a molecular weight of about 3,000,000. It has been described as a high molecular weight polyacrylic acid cross-linked with about 1% of polyallyl sucrose having an average of about 5.8 allyl groups for each molecule of sucrose.

Additional polycarboxylate polymers useful in the present invention are Sokolan PHC-25 ®, a polyacrylic acid available from BASF Corp. and Gantrez ® a poly(methyl vinyl ether/maleic acid) interpolymer available from GAF Corp.

Preferred polycarboxylate polymers of the present invention are non-linear, water-dispersible, polyacrylic acid cross-linked with a polyalkenyl polyether and having a molecular weight of from about 750,000 to about 4,000,000.

Highly preferred examples of these polycarboxylate polymer thickeners for use in the present invention are the Carbopol 600 series resins available from B. F. Goodrich. Especially preferred are Carbopol 616 and 617. It is believed that these resins are more highly cross-linked than the 900 series resins and have molecular weights between about 1,000,000 and 4,000,000. Mixtures of polycarboxylate polymers as herein described may also be used in the present invention. Particularly preferred is a mixture of Carbopol 616 and 617 series resins.

The polycarboxylate polymer thickener is utilized preferably with essentially no clay thickening agents. In fact, it has been found that if the polycarboxylate polymers of the present invention are utilized with clay in the composition of the present invention, a less desirable product results in terms of phase instability. In other words, the polycarboxylate polymer is preferably used instead of clay as a thickening/stabilizing agent in the present compositions.

The polycaroxylate polymer also provides a reduction in the inability to dispense all of the dishwashing detergent product from its container. Without wishing to be bound by theory, it is believed that the compositions of the present invention provide this benefit because the force of cohesion of the composition is greater than the force of adhesion to the container wall. With clay thickener systems, which most commercially available products contain, this dispensing problem can be significant under certain conditions.

Without wishing to be bound by theory, it is also believed that the long chain molecules of the polycarboxylate polymer thickener help to suspend solids in the detergent compositions of the present invention and help to keep the matrix expanded. The polymeric material is also less sensitive than clay thickeners to destruction due to repeated shearing, such as occurs when the composition is vigorously mixed.

If the polycarboxylate polymer is used as the thickening agent in the compositions of the present invention, it is present at a level of from about 0.25% to about 10%, preferably from about 0.5% to about 2%.

The thickening agents are used to provide an apparent yield value of from about 40 to about 800, most preferably from about 100 to about 600, dynes/$cm^2$.

The yield value is an indication of the shear stress at which the gel strength is exceeded and flow is initiated. It is measured herein with a Brookfield RVT model viscometer with a T-bar B spindle at 25° C. utilizing a Helipath drive upward during associated readings. The system is set to 0.5 rpm and a torque reading is taken for the composition to be tested after 30 seconds or after the system is stable. The system is stopped and the rpm is reset to 1.0 rpm. A torque reading is taken for the same composition after 30 seconds or after the system is stable.

Apparent viscosities are calculated from the torque readings using factors .provided with the Brookfield viscometer. An apparent or Brookfield yield value is then calculated as: Brookfield yield value=(apparent viscosity at 0.5 rpm - apparent viscosity at 1 rpm)/100. This is the common method of calculation, published in Carbopol® literature from the B. F. Goodrich Company and in other published references. In the cases of most of the formulations quoted herein, this apparent yield value is approximately four times higher than yield values calculated from shear rate and stress measurements in more rigorous rheological equipment.

The compositions of the present invention which comprise a polycarboxylate thickener may also comprise certain esters of phosphoric acid (phosphate ester) for enhanced phase stability. Phosphate esters are any materials of the general formula:

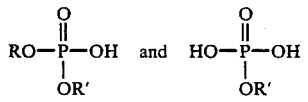

wherein R and R′ are $C_6$–$C_{20}$ alkyl or ethoxylated alkyl groups. Preferably R and R′ are of the general formula: alkyl-$(OCH_2CH_2)Y$ wherein the alkyl substituent is $C_{12}$–$C_{18}$ and Y is between 0 and about 4. Most preferably the alkyl substituant of that formula is $C_{12}$–$C_{18}$ and Y is between about 2 and about 4. Such compounds are prepared by known methods from phosphorus pentoxide, phosphoric acid, or phosphorus oxy halide and alcohols or ethoxylated alcohols.

It will be appreciated that the formula depicted represent mono- and di-esters, and commercial phosphate esters will generally comprise mixtures of the mono- and di-esters, together with some proportion of tri-ester. Typical commercial esters are available under the trademarks "Phospholan" PDB3 (Diamond Shamrock), "Servoxyl" VPAZ (Servo), PCUK-PAE (BASF-Wyandotte), SAPC (Hooker). Preferred for use in the present invention are KN340N and KL340N (Hoescht) and monostearyl acid phosphate (Oxidental Chemical Corp.). Most preferred for use in the present invention is Hostophat-TP-2253 (Hoescht).

The phosphate ester component aids in control of specific gravity of the detergent products of the present invention. The phosphate ester component also helps to maintain stability of the product.

The phosphate esters useful herein also provide protection of silver and silver-plated utensil surfaces. The phosphate ester component also acts as a suds suppressor; thus an additional suds suppressor is not required in the anionic surfactant-containing detergent compositions disclosed herein.

These phosphate esters in combination with the polycarboxylate polymer thickener provide enhanced stability to the liquid automatic dishwashing detergent compositions of the present invention. More specifically, the phosphate ester component helps to keep the solid particles in the compositions of the present invention in suspension. Thus, the combination inhibits the separation out of a liquid layer from compositions of this type.

From about 0.1% to about 5%, preferably from about 0.15% to about 1.0% of the phosphate ester component is used in the compositions of the present invention.

Other Optional Materials

Conventional coloring agents and perfumes can also be added to the instant compositions to enhance their aesthetic appeal and/or consumer acceptability. These materials should, of course, be those dye and perfume varieties which are especially stable against degradation by high pH and/or strong active chlorine bleaching agents if such bleaching agents are also present.

If present, the above-described other optional materials generally comprise no more than about 10% by weight of the total composition and are dissolved, suspended, or emulsified in the present compositions.

Entrained Gas

Optionally, the compositions of the present invention may comprise entrained gas to further ensure stability.

The entrained gas can be any gaseous material that is insoluble in the aqueous liquid. Air is preferred, but any gas that will not react with the composition, such as nitrogen, is also useful.

The entrained gas bubbles are preferably in very finely divided form, preferably less than about 1/32 in. in diameter. They are dispersed throughout the aqueous liquid in an amount, generally from about 1% to about 20%, preferably from about 5% to about 15% by volume, to lower the specific gravity of the overall composition to within from about 5% more than to about 10% less that, preferably within from about 1% more than to about 5% less than the specific gravity of the aqueous liquid without the entrained gas. It is more desirable to be below the specific gravity of the aqueous phase. Any phase separation is then at the bottom of the container, and pouring will tend to remix the separated phase before it is dispensed.

The gas can be admixed with high shear mixing, e.g., through a shear device that has close tolerances to achieve air bubble size reduction. High shear mixing can be attained with shear rates greater than about 1000 $sec^{-1}$, preferably greater than about 15,000 $sec^{-1}$, most preferably greater than 30,000 $sec^{-1}$. The thickening agent (clay or polymeric), on the other hand, should preferably be added last to minimize excessive exposure to shear. Each of these preferred processing steps gives compositions with superior stability. The gas can also be introduced in finely divided form by using a sparger.

Preferred Composition

Preferred compositions of this invention are liquid automatic dishwasher detergent compositions comprising:

(1) from about 12% to about 25% of alkali metal tripolyphosphate or molar equivalent of other alkali metal phosphate species;
(2) from about 2% to about 15% of alkali metal silicate;
(3) from about 3% to about 10% of alkali metal carbonate;
(4) hypochlorite bleach in an amount to provide from about 0.5% to about 1.5% of available chlorine;
(5) from 0%, preferably from about 0.1%, to about 1.5% of sodium n-decyl diphenyloxide disulfonate;
(6) from about 0.5% to about 2% of a polycarboxylate polymer thickening agent selected from the group consisting of polycarboxylate polymers comprising non-linear, water-dispersible, polyacrylic acid cross-linked with a polyalkenyl polyether and having a molecular weight of from about 750,000 to about 4,000,000, and mixtures thereof;
(7) from 0%, preferably from about 0.15%, to about 1.0% of an ethoxylated alkyl ester of phosphoric acid having an average alkyl chain length of from about 12 to about 18 carbon atoms and an average number of ethoxylate units of from about 2 to about 4; and
(8) an amount of an insoluble inorganic zinc salt having an average particle size of less than 250 microns that will provide the composition with from about 0.02% to about 0.2% zinc;

said liquid detergent composition containing no clay suspending agents and having an apparent yield value of from about 100 to about 600 dynes/$cm^2$.

Alternatively, item (5) of the composition may comprise from preferably from about 0.1%, to about 1.5% of a nonionic surfactant of the following structure:

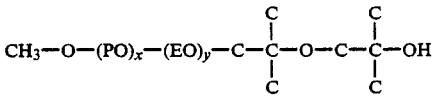

having a molecular weight of about 1900, wherein PO is propylene oxide, EO is ethylene oxide, and the molar ratio of PO to EO is from about 4:1 to about 5:1.

Incorporation of Zinc Salt Into Liquid Composition

The insoluble inorganic zinc salt may be simply admixed, as is, into the finished liquid automatic dishwashing detergent product. This method may result in settling out of the zinc material during shipping and handling. To prevent this from occurring, the preformed particle size of the zinc material should be less than about 250 microns, preferably less than 100 microns, and the apparent yield value of the composition must be kept high, e.g., greater than 400 dynes/$cm^2$.

An alternative method for producing liquid automatic dishwashing detergent compositions of the present invention involves forming the insoluble inorganic zinc salt in-process.

As with the use of preformed insoluble inorganic zinc salts having a small particle size, this alternative process involves control of the zinc particle size and species form to prevent formation of undesirable insoluble material during the dishwashing process or in the aqueous product composition.

Such a method would involve forming a stable colloidal dispersion of an insoluble inorganic zinc salt in an aqueous sodium silicate solution. The particle size of the insoluble inorganic zinc salt dispersed in the silica colloid remains less than 1 micron. Hence, use of an insoluble inorganic zinc salt in this form in the dishwashing process will not result in insolubles on dishwasher parts or dishware.

More specifically, the method would involve first dissolving a soluble zinc salt in an amount of water just sufficient to dissolve the salt. Nonlimiting examples of soluble zinc salts useful in this method include zinc acetate, zinc acetate dihydrate, zinc chloride, zinc bromide, zinc iodide, zinc butyrate, zinc caproate, zinc formate, zinc formate dihydrate, zinc lactate, zinc salicylate, zinc nitrate, zinc nitrate trihydrate, zinc nitrate hexahydrate, zinc sulfate monohydrate, zinc sulfate heptahydrate, sodium zincate, potassium zincate, and zinc tripolyphosphate. The zinc salt solution is then added slowly at a point of high shear to an aqueous sodium silicate solution using high shear mixing equipment. Examples of useful equipment include a WARING Blender, on a lab scale, and a PREMIER dispersator or a Ross high shear mixer, on a larger scale. Mixing should be carried out at high shear speeds, for example, about 7000–8000 rpm. The sodium silicate solution used to make the present invention comprises sodium silicate having an $SiO_2$:$Na_2O$ weight ratio of from about 1:1 to about 3.6:1 in water at about 40 to 50 wt. percent sodium silicate solids. Mixing should continue long enough to assure a homogeneous dispersion of the zinc salt in the silicate solution. The initial turbidity of the starting silicate slurry should not be appreciably changed. To avoid precipitate formation, the ratio of zinc metal to $SiO_2$ in the colloidal dispersion formed should not exceed about 0.1:1 molar ratio. Preferably, the molar ratio of zinc metal to $SiO_2$ in the colloidal dispersion formed is from about 0.01:1 to about 0.1:1. Most preferably, the molar ratio is from about 0.02:1 to about 0.08:1.

This colloidal dispersion can then be used in any liquid automatic dishwashing detergent making process, in place of the silicate slurry alone, to produce product.

If soluble cationic zinc salts are added to the liquid automatic dishwashing detergent compositions of the present invention without forming the above described colloid in silicate, large insoluble aggregates (>250 microns) would be expected to form.

When the colloidal mixtures of soluble zinc salts and alkali metal silicates as produced above are formulated in automatic dishwashing detergent compositions, not only is the glassware protection benefit achieved, but an additional benefit has also been discovered. It has been found that utilization of this procedure provides additional structuring to a polyacrylate polymer thickening system used therewith. By additional structuring is meant an increase in yield value with relatively less increase in flowing viscosity. This, in turn, allows for improved stability of suspended solids without increased dispensing difficulty. Furthermore, the amount of polyacrylate used therewith can be greatly reduced (e.g., cut in half).

Utilization of sodium or potassium zincate to prepare this colloidal dispersion is highly desirable. It has been found that if the zincate is premixed into an aqueous solution of sodium silicate as described above, an especially desirable silico-zincate colloidal mixture is formed. When an alkali metal zincate is utilized to form the silico-zincate colloidal dispersion, it is not necessary to use high shear mixing to combine the two. Use of the zincate avoids the presence of any cationic zinc which would otherwise produce aggregated precipitates of zinc silicate in the absence of high shear mixing.

A particularly desirable embodiment of the liquid automatic dishwashing detergent compositions of the present invention is a liquid automatic dishwashing composition which is essentially a single-phase translucent gel. This is achieved by making a minimum molar substitution of 45–60% of the sodium ions typically present in such compositions with potassium ions. This solubilizes builder and electrolyte anions. Such a composition would be thickened with a polymeric thickener such as a polyacrylate instead of a clay thickener, since the latter would opacify the formula. Such compositions provide advantages with respect to physical shelf stability, dissolution rate, dispensing fluidity, and retention of product in the package vs. formulas which contain suspended salt solids. The sodium ions present in solution generally come from the sodium tripolyphosphate, sodium carbonate, sodium silicate, and sodium hydroxide. The molar substitution of alkali metal cations can be achieved by substituting therefor, various potassium polyphosphates, tetra potassium pyrophosphate, potassium hydroxide, potassium carbonate, potassium bicarbonate, potassium silicate, or mixtures thereof.

The silico-zincate colloidal dispersion described above can be added to such a composition and it will remain translucent (i.e., additional insolubles will not form in product). Alternatively, an alkali metal zincate which contains sufficient alkalinity to ensure aqueous solution clarity can be added to silicate containing some or all of the other composition ingredients, and the absence of cationic zinc will allow silico-zincate formation and avoid uncontrolled precipitation of the zinc by other anions, such as carbonate.

A preferred example of such a translucent gel liquid automatic dishwashing detergent composition comprises:

(a) from about 4% to about 8% of sodium tripolyphosphate;
(b) from about 8% to about 15% of tetra potassium pyrophosphate;
(c) from 0 to about 8% of potassium carbonate;
(d) from 0 to about 6% of sodium carbonate;
(e) hypochlorite bleach in an amount to provide from about 0.5% to about 1.5% of available chlorine;
(f) from 0%, preferably from about 0.1%, to about 2.5% of a detergent surfactant;
(g) from 0 to about 3.5% of alkali metal hydroxide;
(h) from 0%, preferably from about 0.1%, to about 1% of an alkyl ester of phosphoric acid;
(i) from about 0.5% to about 1.5% of a polyacrylic polymer having a molecular weight greater than about 750,000; and
(j) from about 2% to about 15%, preferably from about 3% to about 12%, on a solids basis, of an alkali metal silico-zincate colloidal dispersion wherein the molar ratio of zinc metal to $SiO_2$ is from about 0.01:1 to about 0.1:1; preferably from about 0.02:1 to about 0.08:1;

said liquid detergent composition containing no clay suspending agents and having an apparent yield value of from about 100 to about 600 dynes/cm$^2$.

Preferably the molar ratio of potassium to sodium salts in the composition is greater than about 0.45:0.55 to provide an essentially translucent composition.

These compositions will remain translucent even after extended periods of storage. The silico-zincate colloidal dispersion in these translucent liquid automatic dishwashing detergent compositions provides not only protection against glassware corrosion, but enhanced polymer structuring as well.

The following examples illustrate the present invention. It will be appreciated that other modifications of the present invention, within the skill of those in the automatic liquid dishwashing detergency art, can be undertaken without departing from the spirit and scope of this invention.

All parts, percentages, and ratios herein are by weight unless otherwise specified.

EXAMPLE I

A liquid automatic dishwashing detergent composition of the present invention is as follows:

| Component | Wt. % |
|---|---|
| Sodium tripolyphosphate | 23.4 |
| Sodium silicate solids (2.4 R) | 7.0 |
| Sodium carbonate | 6.0 |
| Available chlorine from sodium hypochlorite | 1.0 |
| Clay (Volclay HPM-20) | 1.0 (±20%) |
| Sodium hydroxide | 0.7 |
| Monostearyl acid phosphate (suds suppressor) | 0.03 |
| Anionic surfactant (Dowfax 3B2) | 0.4 |
| Zinc carbonate (having a particle size less than 250 microns) | 0.4 |
| Minor ingredients and water | Balance |

The composition is prepared as follows. The NaOCl, NaOH, sodium silicate, perfume, and water are combined in a stainless steel container which is placed in an ice bath. A Ross mixer is used to high shear mix the contents of the container while adding the sodium tripolyphosphate (anhydrous) and the sodium carbonate. Mixing is continued until the particle size is acceptably small, i.e. no visible chunks of sodium tripolyphosphate or sodium carbonate particles can be seen in a thin film of the mixture on a stainless steel spatula. Mixing is continued as the monostearyl acid phosphate and anionic surfactant are added. Mixing is continued until the specific gravity of the mixture is about 1.27. Mixing is stopped and the container is removed from the ice bath. A paddle mixer is then placed into the mixture. The zinc carbonate is then paddled into the mixture until it is homogeneously dispersed. The dye is then paddled into the mixture. The clay is then paddled into the mixture, just until incorporated.

This liquid dishwashing detergent has a pH of about 12.2, an apparent yield value of about 600, and a specific gravity of about 1.23. This detergent composition provides enhanced protection against glassware corrosion when used in the automatic dishwasher.

Other compositions herein are obtained when the zinc carbonate is replaced in whole or in part with an alternative insoluble inorganic zinc salt selected from zinc silicate, zinc basic carbonate, zinc oxide, zinc hydroxide, zinc oxalate, zinc monophosphate, zinc pyrophosphate, and mixtures thereof, wherein the material has an average particle size of less than 250 microns.

EXAMPLE II

A liquid automatic dishwashing detergent composition of the present invention is as follows:

| Component | Wt. % |
|---|---|
| Hexahydrate sodium tripolyphosphate | 11.3 |
| Sodium tripolyphosphate (anhydrous basis) | 10.0 |
| Sodium silicate (2.4 R)/zinc silicate silica colloid (as described below) (aqueous basis) | 18.3 |
| Sodium carbonate | 6.0 |
| Available chlorine from sodium hypochlorite | 1.0 |
| Polyacrylate thickener-Carbopol 616 | 0.2 |
| Polyacrylate thickener-Carbopol 617 | 0.25 |
| Ethoxylated phosphate ester-Hostophat TP-2253 | 0.2 |
| Anionic surfactant (Dowfax 3B2) | 0.4 |
| Minor ingredients and water | Balance |

The sodium silicate/zinc silicate slurry is prepared as follows:

| Component | Wt. % |
|---|---|
| Sodium silicate (2.4 R) slurry (47.3% in water) | 81.04 |
| NaOH (48% in water) | 10.83 |
| $ZnSO_4.7H_2O$ (30% in water) | 8.13 |

The aqueous silicate slurry and sodium hydroxide are placed into the stainless steel container of a Waring commercial blender The blender is set on high speed, and the $ZnSO_4.7H_2O$ aqueous solution is slowly added to the silicate mixture in the blender and mixed for one to two minutes total.

It is believed that very fine particles (i.e., less than 1 micron) of insoluble zinc silicate are formed during the process which are dispersed in the silica colloid formed.

The liquid automatic dishwashing detergent composition is prepared as follows. The NaOCl, NaOH, sodium silicate/zinc silicate silica colloid, perfume, and water are combined in a stainless steel container which is placed in an ice bath. A Ross mixer is used to high shear mix the contents of the container while adding the hexahydrate sodium tripolyphosphate, the sodium tripolyphosphate (anhydrous) and the sodium carbonate. Mixing is continued until the particle size is acceptably small, i.e. no visible chunks of sodium tripolyphospahte or sodium carbonate particles can be seen in a thin film of the mixture on a stainless steel spatula. Mixing is continued as the phosphate ester and anionic surfactant are added. Mixing is continued until the specific gravity of the mixture is about 1.27. Mixing is then stopped and the container is removed from the ice bath. A paddle mixer is then placed into the mixture. The dye is then paddled into the mixture. In a separate container the polycarboxylate polymer is premixed with enough water to moisten the polymer. The polymer slurry (2.5%) is then paddled into the mixture of the other components.

This liquid dishwashing detergent has a pH of about 12.2, an apparent yield value of about 600, and a specific gravity of about 1.23. This detergent composition provides enhanced protection against glassware corrosion in the dishwasher.

EXAMPLE III

A liquid automatic dishwashing detergent composition of the invention is as follows:

| Component | Wt. % |
|---|---|
| Sodium tripolyphosphate (anhydrous basis) | 20.0 |
| Capped polyalkylene oxide block copolymer Nonionic surfactant of the following formula: | 1.0 |

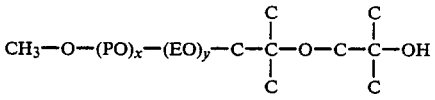

| | |
|---|---|
| Sodium carbonate | 6.0 |
| Sodium hydroxide | 0.95 |
| Available chlorine from sodium hypochlorite | 1.0 |
| Sodium silicate (2.4R) | 7.0 |
| Zinc oxide (having a particle size less than 100 microns) | 1.25 |
| Polyacrylate thickener-Carbopol 616 | 0.20 |
| Polyacrylate thickener-Carbopol 617 | 0.25 |
| Ethoxylated phosphate ester-Hostophat TP-2253 | 0.20 |

The composition is prepared as follows. The NaOCl, NaOH, sodium silicate, perfume, phosphate ester and water are combined in a stainless steel container which is placed in an ice bath. A Ross mixer is used to high shear mix the contents of the container while adding the hexahydrate sodium tripolyphosphate, the sodium tripolyphosphate (anhydrous) and the sodium carbonate. Mixing is continued until the particle size is acceptably small, i.e. no visible chunks of sodium tripolyphosphate or sodium carbonate particles can be seen in a thin film of the mixture on a stainless steel spatula. Mixing is continued as the nonionic surfactant is added. Mixing is then stopped and the container is removed from the ice bath. A paddle mixer is then placed into the mixture. The zinc oxide is paddled into the composition until homogeneously dispersed. The dye is then paddled into the mixture. In a separate container the polycarboxylate polymer is premixed with enough water to moisten the polymer. The polymer slurry (2.5%) is then paddled into the mixture of the other components.

The resulting automatic dishwashing detergent composition has a pH (1% solution) of about 11, an apparent yield value of about 400 dynes/cm$^2$, and a specific gravity of about 1.32. This detergent composition provides enhanced protection against glassware corrosion in the dishwasher.

Other compositions of the present invention are obtained when the zinc oxide is replaced in whole or in part with alternative insoluble inorganic zinc salts selected from zinc carbonate, zinc basic carbonate, zinc silicate, zinc hydroxide, zinc oxalate, zinc monophosphate, zinc pyrophosphate, and mixtures thereof, wherein the material has an average particle size of less than 250 microns.

EXAMPLE IV

Liquid automatic dishwashing compositions of the present invention are as follows.

| | Formula Parts, % of Active Ingredient | | |
|---|---|---|---|
| Ingredient | A | B | C |
| STPP (Sodium tripolyphosphate) | 10.00 | 10.00 | 10.00 |

-continued

| Ingredient | Formula Parts, % of Active Ingredient A | B | C |
|---|---|---|---|
| STPP, as hexahydrate | 8.81 | 8.81 | 8.81 |
| Na silicate, 2.4 ratio | 7.01 | 7.01 | 7.01 |
| $Na_2CO_3$ | 6.00 | 6.00 | 6.00 |
| Sodium hydroxide (NaOH) | 0.95 | 0.95 | 0.95 |
| NaOCl (as AvCl) | 1.00 | 1.00 | 1.00 |
| Phosphate ester | 0.20 | 0.20 | 0.20 |
| Lithium hydroxy stearate | 0.10 | 0.10 | 0.10 |
| Carbopol 617 (PAA) | 0.45 | 0.40 | 0.45 |
| Zinc sulfate | — | 0.25 | — |
| Zinc carbonate (having a particle size less than 250 microns) | — | — | 0.20 |
| Perfume, dyes, water | Balance | Balance | Balance |

Composition A is made with all ingredients but perfume, dyes, and PAA mixed vigorously and added with mild stirring to an aqueous dispersion of the PAA, with perfume and dyes then added.

Composition B is made similarly, except that zinc sulfate heptahydrate is dissolved in water and added in a high-shear mixer to the sodium silicate, so that a stable colloidal mixture is formed and no opaque precipitate is observed. The colloid is thought to contain a dispersion of fine particles of zinc silicate, (i.e., particles smaller than 1 micron in size). The colloidal mixture is added to the composition after the PAA is in the formula.

Composition C is made similarly to A, except that an aqueous dispersion of powdered insoluble zinc carbonate is stirred in after the PAA.

All compositions are opaque thixotropic slurries with apparent yield values ranging from 180 to 330 dynes/cm$^2$.

Use of compositions B and C in the dishwasher provides protection against glassware corrosion.

EXAMPLE V

Liquid automatic dishwashing compositions of the present invention are as follows.

| Ingredient | Formula Parts, % of Active Ingredient |
|---|---|
| Sodium tripolyphosphate (STPP) | 4.67 |
| Tetrapotassium pyrophosphate (TKPP) | 12.60 |
| Sodium silicate (2.4 ratio) | 6.54 |
| Potassium zincate ($5K_2O.ZnO$) | 0.41 |
| Potassium carbonate ($K_2CO_3$) | 4.92 |
| Sodium carbonate ($Na_2CO_3$) | 1.84 |
| Sodium hypochlorite (NaOCl)(as av.Cl) | 0.93 |
| Potassium hydroxide (KOH) | 0.43 |
| Monostearylacidphosphate (MSAP) | 0.03 |
| Polyacrylic acid (PAA) | 0.65 |
| Potassium zincate | 0–0.06 |
| Perfume, dye, water | Balance |

The potassium zincate is prepared by dissolving 20.34 grams of zinc oxide in 311.76 grams of 45% KOH at about 160° F. with stirring to produce a clear solution of 41.45% zincate at composition $5K_2O.ZnO$. This mixture is then blended into 47.3 wt. percent aqueous sodium silicate at a weight ratio of 1:15, to form a silico-zincate colloidal dispersion. All other ingredients except perfume, dye, MSAP, and PAA are mixed vigorously with the remaining water to form a clear solution. This solution is stirred into a predispersed gel mixture of 3.4% PAA in water. The silico-zincate colloidal dispersion is then stirred into this mixture. Perfume, dyes, and a 2.6% aqueous dispersion of MSAP are then added. The resultant composition is a translucent thixotropic gel with an apparent yield value of about 300 dynes/cm$^2$.

Use of this composition in the dishwasher provides protection against glassware corrosion. The silico-zincate colloidal dispersion provides the additional benefit of increased polymer structuring to the composition.

What is claimed is:

1. A liquid automatic dishwashing detergent composition comprising:

(a) from 0% to about 5% of detergent surfactant;

(b) from about 5% to about 40% of detergency builder;

(c) hypochlorite bleach to yield available chlorine in an amount of from 0% to about 2.5%;

(d) from about 0.25% to 10% of a thickening agent; and (e) an amount of an insoluble inorganic zinc compound, having an average particle size less than about 250 microns, that will provide the composition with from about 0 01% to about 1.0% zinc;

said composition having an apparent yield value of from about 40 to about 800 dynes/cm$^2$.

2. The composition of claim 1 comprising an amount of the insoluble inorganic zinc compound that will provide the composition with from about 0.02% to about 0.2% zinc.

3. The composition of claim 1 wherein said insoluble inorganic zinc compound is selected from the group consisting of zinc silicate, zinc carbonate, zinc basic carbonate, zinc oxide, zinc hydroxide, zinc monophosphate, zinc pyrophosphate, and mixtures thereof.

4. The composition of claim 3 wherein the insoluble inorganic zinc compound is zinc carbonate.

5. The composition of claim 1 wherein the thickening agent is a clay thickening agent.

6. The composition of claim 5 wherein the clay thickening agent is selected from the group consisting of smectite and attapulgite clays and mixtures thereof.

7. The composition of claim 6 wherein the clay thickening agent comprises from about 0.5% to about 2% of the composition.

8. The composition of claim 1 wherein the thickening agent is a high molecular weight polycarboxylate polymer thickening agent.

9. The composition of claim 8 wherein the polycarboxylate polymer thickening agent comprises from about 0.5% to about 2% of the composition.

10. The composition of claim 9° wherein the polycarboxylate polymer thickening agent is selected from the group consisting of polycarboxylate polymers comprising non-linear, water-dispersible polyacrylic acid cross-linked with polyalkenyl polyether having a molecular weight of from about 750,000 to about 4,000,000; and mixtures thereof.

11. The composition of claim 1 which comprises from about 0.1% to about 2.5% of said surfactant and wherein said surfactant is an anionic surfactant and is selected from the group consisting of $C_{8-18}$ alkyl sulfates, $C_{8-18}$ alkyl sulfonates, and mixtures thereof.

12. The composition of claim 1 which comprises from about 0.1% to about 2.5% of said surfactant and wherein said surfactant is a nonionic surfactant and is selected from the group consisting of

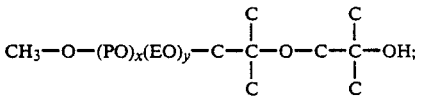

and

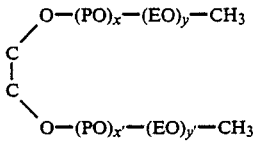

having molecular weights of about 1900, wherein PO is propylene oxide, EO is ethylene oxide, and the molar ratio of PO to EO is from about 4:1 to about 5:1, and mixtures thereof.

13. The composition of claim 11 wherein said detergency builder is selected from the group consisting of sodium tripolyphosphate, sodium carbonate, potassium pyrophosphate, potassium carbonate, sodium pyrophosphate, and mixtures thereof.

14. The composition of claim 13 which additionally comprises from about 2% to about 15% of sodium silicate.

15. The composition of claim 1 which additionally comprises from about 0.5% to about 1.5% sodium hydroxide.

16. A liquid automatic dishwashing detergent composition comprising:

(a) from about 12% to about 25% of alkali metal tripolyphosphate;

(b) from about 2% to about 15% of alkali metal silicate;

(c) from about 3% to about 10% of alkali metal carbonate;

(d) hypochlorite bleach in an amount to provide from about 0.5% to about 1.5% of available chlorine;

(e) from about 0.1% to about 1.5% of

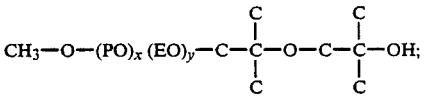

having a molecular weight of about 1900, wherein PO is propylene oxide, EO is ethylene oxide and the ratio of PO to EO is from about 4:1 to about 5:1;

(f) from about 0.5% to about 2% of a polycarboxylate polymer thickening agent selected from the group consisting of polycarboxylate polymers comprising non-linear, water-dis persible polyacrylic acid cross-linked with a polyalkenyl polyether and having a molecular weight of from about 750,000 to about 4,000,000, and mixtures thereof;

(g) from 0% to about 1% of an ethoxylated alkyl ester of phosphoric acid having an average alkyl chain length of from about 12 to about 18 carbon atoms and an average number of ethoxylate units of from about 2 to about 4;

(h) an amount of an insoluble inorganic zinc compound, having an average particle size of less than about 250 microns, that will provide the composition with from about 0.02% to about 0.2% zinc;

said liquid detergent composition containing no clay suspension agents and having an apparent yield value of from about 100 to about 600 dynes/cm$^2$.

17. The composition of claim 16 wherein the insoluble inorganic zinc compound is selected from the group consisting of zinc silicate, zinc carbonate, zinc carbonate basic, zinc oxide, zinc hydroxide, zinc monophosphate, zinc pyrophosphate, and mixtures thereof.

18. A liquid automatic dishwashing detergent composition comprising:

(a) from about 12% to about 25% of alkali metal tripolyphosphate;

(b) from about 2% to about 15% of alkali metal silicate;

(c) from about 3% to about 10% of alkali metal carbonate;

(d) hypochlorite bleach in an amount to provide from about 0.5% to about 1.5% of available chlorine;

(e) from 0% to about 1.5% of sodium n-decyl diphenyloxide disulfonate;

(f) from about 0.5% to about 2% of a polycarboxylate polymer thickening agent selected from the group consisting of polycarboxylate polymers comprising non-linear, water-dispersible polyacrylic acid cross-linked with a polyalkenyl polyether and having a molecular weight of from about 750,000 to about 4,000,000, and mixtures thereof;

(g) from 0% to about 1% of an ethoxylated alkyl ester of phosphoric acid having an average alkyl chain length of from about 12 to about 18 carbon atoms and an average number of ethoxylate units of from about 2 to about 4;

(h) an amount of an insoluble inorganic zinc compound, having an average particle size of less than about 250 microns, that will provide the composition with from about 0.02% to about 0.2% zinc;

said liquid detergent composition containing no clay suspension agents and having an apparent yield value of from about 100 to about 600 dynes/cm$^2$.

19. The composition of claim 18 wherein the insoluble inorganic zinc compound is selected from the group consisting of zinc silicate, zinc carbonate, zinc carbonate basic, zinc oxide, zinc hydroxide, zinc monophosphate, zinc pyrophosphate, and mixtures thereof.

20. A liquid automatic dishwashing detergent composition comprising:

(a) from about 4% to about 8% of sodium tripolyphosphate;

(b) from about 8% to about 15% of tetrapotassium pyrophosphate;

(c) from 0 to about 8% of potassium carbonate;

(d) from 0 to about 6% of sodium carbonate;

(e) hypochlorite bleach in an amount to provide the composition with from about 0.5% to about 1.5% of available chlorine;

(f) from about 0.1% to about 2.5% of a bleach stable surfactant;

(g) from 0 to about 3.5% of alkali metal hydroxide;

(h) from about 0.1% to about 1% of an alkyl ester of phosphoric acid;

(i) from about 0.5% to about 1.5% of a polyacrylic polymer having a molecular weight greater than about 750,000;

(j) from about 3% to about 12%, on a solids basis, of an alkali metal silico-zincate colloidal dispersion wherein the molar ratio of zinc metal to $SiO_2$ is from about 0.01:1 to about 0.1:1;

said liquid detergent containing no clay suspension agents and having an apparent yield value of from about 100 to about 600 dynes/cm$^2$.

21. The composition of claim 20 wherein the molar ratio of potassium to sodium salts in the composition is greater than about 0.45:0.55 to provide an essentially translucent composition.

22. A method for preparing the silico-zincate colloidal dispersion of claim 20 comprising:

(a) dissolving an alkali metal zincate in water;

(b) preparing an aqueous solution of alkali metal silicate having a solids content of from about 40% to about 50% by weight;

(c) mixing the solution of (a) with the solution of (b) to produce a silico-zincate colloidal dispersion wherein the ratio of zinc metal to Si02 is from about 0.01:1 to about 0.1:1.

23. The method of claim 22 wherein the molar ratio of zinc metal to $SiO_2$ is from about 0.02:1 to about 0.08:1.

24. The method of claim 23 wherein the alkali metal zincate is selected from the group consisting of potassium zincate, sodium zincate, and mixtures thereof.

25. The method of claim 24 wherein the alkali metal silicate is sodium silicate having an $SiO_2$:$Na_2O$ ratio of from about 1:1 to about 3.6:1.

26. A method for inhibiting corrosion of glassware in an automatic dishwashing process comprising contacting the glassware with wash water containing the composition of claim 1.

27. A method for inhibiting corrosion of glassware in an automatic dishwashing process comprising contacting the glassware with wash water containing the composition of claim 16.

28. A method for inhibiting corrosion of glassware in an automatic dishwashing process comprising contacting the glassware with wash water containing the composition of claim 18.

29. A method for inhibiting corrosion of glassware in an automatic dishwashing process comprising contacting the glassware with wash water containing the composition of claim 20.

* * * * *

UNITED STATES PATENT AND TRADEMARK OFFICE

CERTIFICATE OF CORRECTION

PATENT NO. : 4,933,101

DATED : June 12, 1990

INVENTOR(S) : William A. Cilley and Rodney M. Wise

It is certified that error appears in the above-identified patent and that said Letters Patent is hereby corrected as shown below:

Column 24, line 22 of Claim 1, "0 01%" should read -- 0.01% -- .

Column 25, line 25 of Claim 15, "Claim 1" should read -- Claim 14 -- .

Column 25, line 51 of Claim 16, "water-dis persible" should read -- water-dispersible -- .

Signed and Sealed this

Seventeenth Day of December, 1991

*Attest:*

HARRY F. MANBECK, JR.

*Attesting Officer*

*Commissioner of Patents and Trademarks*